US005836670A

United States Patent [19]

Gilson

[11] Patent Number: 5,836,670

[45] Date of Patent: Nov. 17, 1998

[54] NECKTIE WITH A FLAT FLASHLIGHT CONCEALED THEREIN

[76] Inventor: Warren E. Gilson, 601 N. Segoe, Unit 104, Madison, Wis. 53705

[21] Appl. No.: 803,863

[22] Filed: Feb. 24, 1997

[51] Int. Cl.[6] ..... F21L 15/08; F21L 7/00

[52] U.S. Cl. ..... 362/103; 362/108; 362/200

[58] Field of Search ..... 362/103, 108, 362/157, 189, 200

[56] References Cited

U.S. PATENT DOCUMENTS

| | | | |
|---|---|---|---|
| 682,742 | 9/1901 | Plass | 362/200 |
| 2,320,193 | 5/1943 | Powell et al. | 362/108 |
| 3,083,295 | 3/1963 | Baker | 362/108 |
| 3,206,765 | 9/1965 | Sherman | 2/144 |
| 3,731,084 | 5/1973 | Trevorrow | 362/108 |
| 4,164,008 | 8/1979 | Miller et al. | 362/103 |
| 4,231,079 | 10/1980 | Heminover | 362/106 |
| 4,262,324 | 4/1981 | Murphy | 362/104 |
| 4,283,797 | 8/1981 | Seider | 2/151 |
| 4,308,572 | 12/1981 | Davidson et al. | 362/103 |
| 4,462,064 | 7/1984 | Schweitzer | 362/105 |
| 4,823,240 | 4/1989 | Shenker | 362/103 |
| 4,843,644 | 7/1989 | Sugarman | 2/46 |
| 5,018,057 | 5/1991 | Biggs et al. | 362/295 |
| 5,038,271 | 8/1991 | LoBello | 352/154 |
| 5,201,076 | 4/1993 | Schemine, Jr. | 2/145 |
| 5,245,516 | 9/1993 | De Haas et al. | 362/108 |
| 5,249,106 | 9/1993 | Barnes et al. | 362/108 |
| 5,412,896 | 5/1995 | Morgan | 362/108 |
| 5,463,539 | 10/1995 | Vandenbelt et al. | 362/189 |
| 5,531,601 | 7/1996 | Amoroso | 439/37 |
| 5,580,154 | 12/1996 | Coulter et al. | 362/103 |
| 5,613,756 | 3/1997 | Allen | 362/103 |

FOREIGN PATENT DOCUMENTS

| | | | |
|---|---|---|---|
| 2 604 239 | 3/1988 | France | 362/157 |

OTHER PUBLICATIONS

Advertising sheet of Lumatec Industries Inc. (of unknown date) disclosing Flash Card® flashlight.

*Primary Examiner*—Ira S. Lazarus
*Assistant Examiner*—Ljiljana V. Ciric
*Attorney, Agent, or Firm*—Mason, Kolehmainen, Rathburn & Wyss

[57] ABSTRACT

A generally flat flashlight is concealed in an article of clothing or other accessory used by a person to illuminate an area adjacent an opening in the article of clothing or other accessory. In the case of a necktie that is to be worn around the neck of a person, the necktie is made of fabric or textile material and is formed into an elongated flattened tubular configuration with front and rear plies so that an inner area is formed between the plies. Adjacent a distal end portion of the necktie, a pocket or holding area is formed within the inner area of the necktie with an opening formed at the distal end thereof. The relatively flat, flashlight that is battery operated is adapted to be disposed within the pocket with the light emitting portion of the flashlight directed to the opening so that when the flashlight is actuated, light emitted from the flashlight will illuminate the area beyond the end of the necktie.

5 Claims, 1 Drawing Sheet

NECKTIE WITH A FLAT FLASHLIGHT CONCEALED THEREIN

BACKGROUND OF THE INVENTION

1. Field of the Invention

This invention relates to a concealed flashlight, and more particularly, to the concealment of a relatively flat flashlight within an article of clothing or an accessory such as a necktie.

2. Background of the Invention

It is common for the lights to be turned off during the performance of an event, such as an opera or play. Nevertheless, the people attending these events would like to be able to read the program, playbill or other information that is distributed at the event during the performance of the event when the lights are off. Even though it is possible to use a separate, small flashlight at the event so that the material can be read during the performance while the lights are turned off, it would be advantageous to have a flashlight concealed within a garment or accessory, such as a necktie, being worn by the person attending the event so that the flashlight is readily accessible for use during that event, but at the same time not visible to other people.

Accordingly, it is an object of the present invention to provide a new and improved concealed flashlight that is inconspicuously concealed within a garment or accessory, such as for example, a necktie being worn by a person.

It is another object of the present invention to provide a new and improved necktie that includes a relatively flat flashlight disposed within the necktie so that light from the flashlight can be emitted through an opening in the necktie in order to illuminate the area beyond the end of the necktie.

SUMMARY OF THE INVENTION

In accordance with these and many other objects of the present invention, a relatively flat flashlight is adapted to be concealed within a garment or other accessory worn or used by a person. While the flashlight can be concealed within a belt or scarf worn on a person or a purse used by a person, in one embodiment of the present invention, the flashlight is concealed within a necktie to be worn around the neck of a person. The necktie is made of fabric or textile material and is formed into an elongated flattened tubular configuration with front and rear plies so that an inner area is formed between the plies. Adjacent a distal end portion of the necktie, a pocket or holding area is formed within the inner area of the necktie by stitching or the like the rear ply or material of the necktie to the front ply. An opening is formed at the distal end of this pocket. A relatively flat flashlight is adapted to be placed within the pocket with the light emitting portion of the flashlight directed to the opening so that when the flashlight is actuated, light emitted from the flashlight will illuminate the area beyond the end of the necktie.

BRIEF DESCRIPTION OF THE DRAWING

These and many other objects and advantages of the present invention will become readily apparent from consideration of the following detailed description of the embodiment of the invention shown in the accompanying drawing wherein.

DETAILED DESCRIPTION OF THE PREFERRED EMBODIMENT

Figure 1:
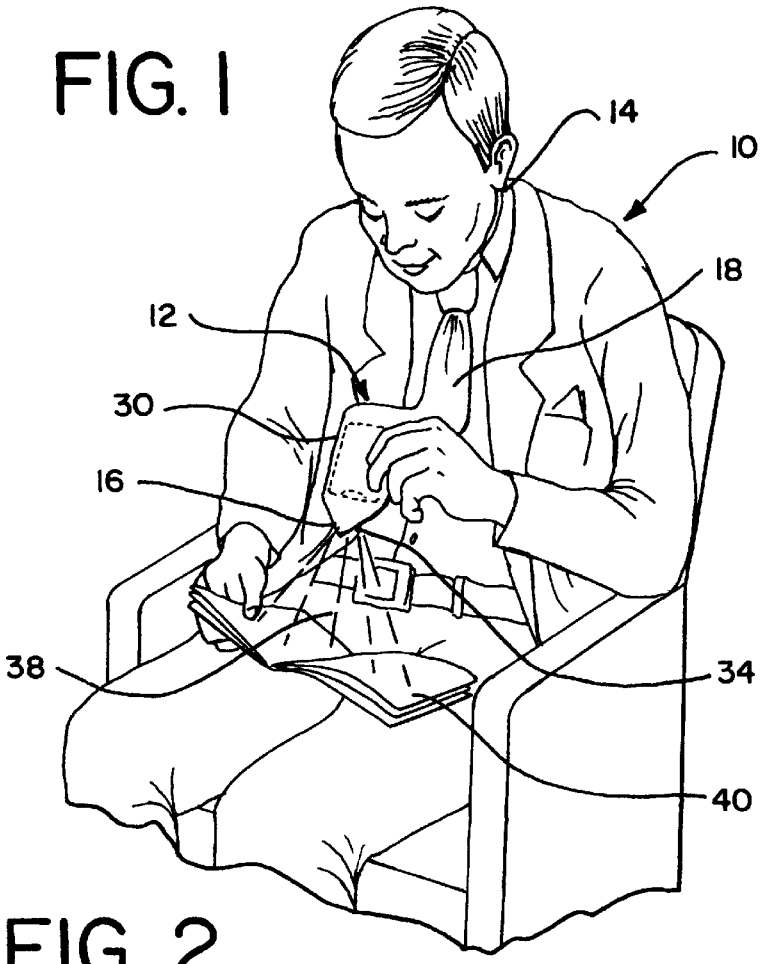
FIG. 1 is perspective view of a person wearing and using a necktie embodying the present invention.
Figure 2:
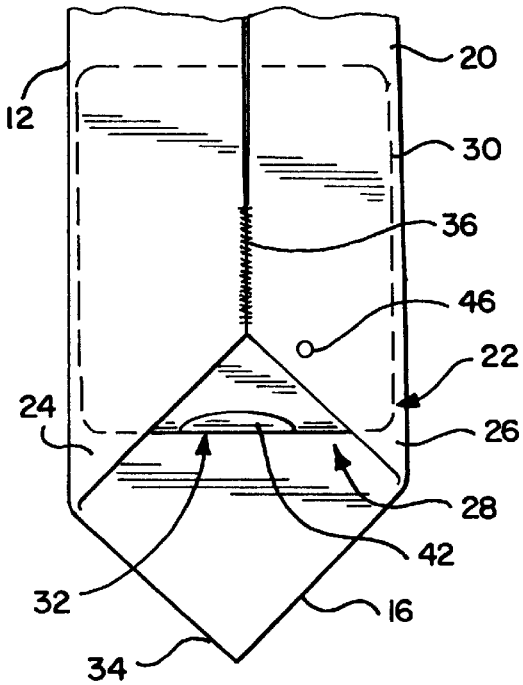
FIG. 2 is rear view of a distal end portion of the necktie of FIG. 1 showing the location of a flashlight disposed within the necktie.

Referring now more specifically to FIG. 1, therein is disclosed a person 10 shown wearing a necktie that is generally designated by the reference numeral 12 and that embodies the present invention. The necktie 12 is adapted to be tied around a neck 14 of the person 10 in the manner generally known and extends to a front distal end portion 16. The necktie 10 is formed from an outer or front ply 18 of material and an inner or rear ply 20 of material that are shaped into an elongated flattened tubular configuration. As is shown in FIGS. 1 and 2, a pocket or holding area 22 is formed adjacent the distal end portion 16 between the front ply 18 and the rear ply 20 by stitching the ends of the rear ply 20 to the front ply 18 of the necktie 12 at areas 24 and 26. An opening 28 is formed at the distal end of the pocket 22. A relatively flat flashlight 30 is adapted to be disposed in the pocket 22 with a light emitting portion 32 of the flashlight 30 being disposed within the opening 28 so that light emitted from the flashlight 30 will illuminate the area beyond the pocket 22 and a distal end 34 of the necktie 12.

The necktie 12 can be formed of any appropriate fabric or textile material. The material is formed into a generally flat tubular configuration by stitching the rear ply 20 of the necktie 12 along a center line 36. As a result, the front ply 18 of the necktie 12 has no visible seam or the like. As illustrated in FIGS. 1 and 2, the distal end 34 of the necktie 12 is tapered inwardly so as to be formed into a point, but alternatively, the distal end 34 can be of any appropriate shape such as being flat across the width of the necktie 12. A fabric lining (not shown) may be placed within the tubular body portion of the necktie 12 between the outer ply 18 and the inner ply 20.

The flashlight 30 is adapted to be concealed within the pocket 22 of the necktie 12. The pocket 22 can be formed by stitching the rear ply 20 to the outer ply 18 at the areas 24 and 26 either after the flashlight 30 has been disposed within the tubular body of the necktie 12 as is illustrated in FIGS. 1 and 2 or before the flashlight 30 is disposed within the pocket 22 of the necktie 12. In the latter case, an opening 37 between the ends of the rear ply 20 of the necktie 12 needs to extend sufficiently above the stitched center line 36 of the rear ply 20 to permit the insertion of the flashlight 30 into the pocket 22 after the necktie has been tied around the neck of the person 10. Alternatively, a holding pouch or the like can be affixed within the necktie 12, in which pouch the flashlight 30 can be disposed. Such a holding pouch can be affixed within the necktie 12 between the outer ply 18 and the inner ply 20 by any appropriate means.

When the flashlight 30 is so disposed within the necktie 12, the light emitting portion 32 of the flashlight projects through the opening 28. With the light emitting portion 32 being so positioned relative to the opening 28, light being emitted from the flashlight 30 when it is actuated will illuminate outwardly from the pocket 22, towards the distal end 34 of the necktie 12 and beyond the distal end 34 of the necktie 12. The manner in which the flashlight 30 will illuminate beyond the necktie 12 is illustrated in FIG. 1 where rays of light 38 are shown projecting from the light emitting portion 32 of the flashlight 30 beyond the distal end 34 of the necktie 12 onto a book or program 40 held by the wearer 10 of the necktie 12.

Figure 4:
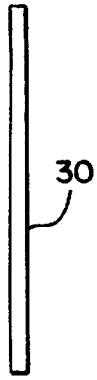
FIG. 4 is a side view of the flashlight of FIG. 3.
Figure 3:
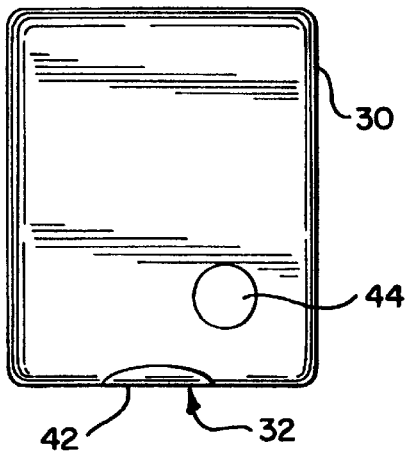
FIG. 3 is a front view of a flashlight that can be used in the necktie of FIGS. 1 and 2.

As is more specifically shown in FIGS. 3 and 4, the flashlight 30 is generally rectangular in shape (FIG. 3) and is generally flat in cross section (FIG. 4). As a result, the flashlight 30 can be disposed inconspicuously within the pocket 22 of the necktie 12. One such type of flashlight that can be used for the flashlight 30 is a battery operated flashlight distributed by Lumatec Industries Inc. of Austin, Tex. under the trademark FLASH CARD®.

The light emitting portion 32 of the flashlight 30 includes a lens 42 through which light is emitted from a battery operated bulb (not shown) within the flashlight 30 when an actuation button 44 (FIG. 3) is depressed. When so actuated, light from the flashlight 30 will be emitted from the end 16 of the necktie 12 as is discussed above and is illustrated in FIG. 1. In order to assist the person 10 to know where to depress the necktie 12 to actuate the actuation button 44, indicia or a button 46 can be placed on the back surface of the inner ply 20 in alignment with the location of the actuation button 44 or alternatively, a projection can be inserted in the flashlight 30 in alignment with the actuation button 44 or on the actuation button 44 so that the person 10 can more readily locate the actuation button 44 by feeling the projection.

Obviously, many modifications and variations of the present invention are possible in light of the above teachings. In this regard, the flashlight 30 is illustrated as being concealed within one type of article of clothing, i.e., a necktie. However, the flashlight 30 may be concealed within any type of article of clothing worn by a person or any type of accessory or the like that would be carried by a person including for example, a purse. Thus, it is to be understood that, within the scope of the appended claims, the invention may be practiced otherwise than as specifically described above.

What is claimed and desired to be secured by Letters Patent of the United States is:

1. A necktie for illuminating an area adjacent a distal end portion of said necktie, said necktie having an inner space between a front ply and a rear ply and comprising:

a holding means formed in said inner space adjacent said distal end portion of said necktie, said holding means having an illumination opening; and a generally flat flashlight capable of being activated to emit light therefrom and disposed in said holding means such that light emitted from said flashlight when said flashlight is activated projects through said illumination opening from said distal end portion of said necktie whereby an area adjacent said distal end portion of said necktie is illuminated.

2. A necktie as set forth in claim 1 wherein said flashlight has an actuation means responsive to being depressed to activate said flashlight so that light is emitted from said flashlight through said illumination opening.

3. A necktie as set forth in claim 2 including indication means on said rear ply of said necktie to assist in locating said actuation means.

4. A necktie as set forth in claim 1 wherein said holding means is formed by affixing a portion of said rear ply to said front ply adjacent said illumination opening.

5. A necktie as set forth in claim 1 wherein said flashlight is battery-operated.

* * * * *